United States Patent [19]

Wilms

[11] Patent Number: 4,503,642

[45] Date of Patent: Mar. 12, 1985

[54] BELT GRINDER FOR CHIP BOARD AND THE LIKE

[75] Inventor: Friedrich Wilms, Krefeld, Fed. Rep. of Germany

[73] Assignee: Eduard Küsters, Krefeld, Fed. Rep. of Germany

[21] Appl. No.: 491,277

[22] Filed: May 4, 1983

[30] Foreign Application Priority Data

May 13, 1982 [DE] Fed. Rep. of Germany ..... 3217935

[51] Int. Cl.[3] ..... B24B 21/00

[52] U.S. Cl. ..... 51/139; 51/78; 51/135 R; 51/140; 51/141

[58] Field of Search ..... 51/135 R, 139, 141, 51/140, 78; 29/116 AD

[56] References Cited

U.S. PATENT DOCUMENTS

| | | | |
|---|---|---|---|
| 1,631,898 | 6/1927 | Swan | 51/135 |
| 1,927,330 | 9/1933 | Williams | 51/141 |
| 2,316,582 | 4/1943 | Hercik | 51/139 |
| 2,404,917 | 7/1946 | Murdock | 51/139 |
| 3,169,352 | 2/1965 | Smith | 51/140 |
| 4,188,698 | 2/1980 | Appenzeller | 29/116 AD |

FOREIGN PATENT DOCUMENTS

| | | | |
|---|---|---|---|
| 2028203A | 3/1980 | United Kingdom | 29/116 AD |

OTHER PUBLICATIONS

Coated Abrasive Machining is Now a Science, Abrasive Engineering, May–Jun. 1974, pp. 20–22.

*Primary Examiner*—James G. Smith
*Assistant Examiner*—J. T. Zatarga
*Attorney, Agent, or Firm*—Kenyon & Kenyon

[57] ABSTRACT

A belt grinder has a pressure roll which is designed as a deflection controlled roll with a hollow cylinder which is supported on a rotation-proof crosshead, and is braced from the inside against the crosshead, particularly hydraulically, with a space between its inside circumference and the crosshead.

4 Claims, 6 Drawing Figures

30
38
33
32
34
34
2'
39
36
37

2'
38
32
33

P
34
39
32'
31
35
36
30
35
31
32'

VI
43
4
30

2''
32
6
40
5
44
VI
1

2''
31
30
32

31
32'
32'
42
41
40

BELT GRINDER FOR CHIP BOARD AND THE LIKE

BACKGROUND OF THE INVENTION

This invention relates to belt grinders in general and more particularly to an improved belt grinder.

Several designs of belt grinders for chip board and the like, including: an endless grinding belt which revolves in a longitudinal plane perpendicular to a feed direction for the board and extends over the width of the board; a counterpressure element parallel to the pressure roll, the pressure roll and counterpressure element together defining a grinding gap through which the grinding belt is conducted; and a feeding device for the board, advancing in the feed direction, are known.

In a first design, the grinding belt is looped around the pressure roll. A support roll which is parallel to the pressure roll and forms the counterpressure element, is provided in the region of the looping angle. The board is pushed through the gap between the two rolls which forms the grinding gap.

In another design, the grinding belt runs over a grinding beam, adjacent to which may be deflection rolls which are arranged on both sides at the same height. In this case, the grinding beam forms the counterpressure element. The pressure roll is arranged above the grinding beam. The grinding gap is formed between the pressure roll and the top side of the grinding beam.

In order to bring about a satisfactory grinding operation with economical operating speeds, a certain line pressure on the order of about 104 N/m is required in the grinding gap. The line pressure must, of course, be very uniform over the width of the sheet, because otherwise the removal is very nonuniform and the board has a poor thickness tolerance. The thickness tolerances are very critical, especially in the further processing of the sheets on automatic veneering, laminating and varnishing machines. The requirements extend here to a tolerance of +0.1 mm. To maintain such tolerances is no easy task, especially for sheet widths of up to about 2.5 m, because the pressure rolls are already bent appreciably under the line pressure at such lengths, so that the sheets have the tendency to become thicker in the center. To eliminate this influence, the pressure rolls must have a relatively large diameter.

It is an object of the present invention to design a belt grinder of the type described above in such a manner that narrow tolerances of the thickness of the ground boards are possible without excessively increasing the diameter of the pressure rolls.

SUMMARY OF THE INVENTION

This problem is solved by using a pressure roll designed as a deflection controlled roll which comprises a hollow cylinder supported on a rotation-proof crosshead, the hollow cylinder braced from the inside against the crosshead, particularly hydraulically, and having its inside circumference spaced from the crosshead.

Deflection controlled rolls of this type permit maintaining a uniform line pressure or uniform height of the grinding gap, everywhere in the grinding gap even if the counterpressure element is deformed and gives way under the line pressure. Thereby, much smaller tolerances are possible than in conventional belt grinders. The diameters of such rolls are relatively small, which has at least structural advantages. To this must be added, however, that hydraulically supported hollow rolls have a damping effect, so that the formation of vibrations in the rolling gap is counteracted.

In the grinding gap, the pressure roll is stressed in two ways, namely, by a first stress due to the line pressure, perpendicular to the sheet surface, and by a second stress, in the travel direction of the sheet, due to the feed forces. A resultant of these forces is obtained which is not perpendicular to the surface of the sheet and accordingly produces a deflection in a plane not perpendicular to the sheet surface. This deflection can be counteracted by inclining the action plane.

In principle, the invention is suited for all kinds of belt grinding machines with pressure rolls. Special advantages are realized, however, if that type of belt grinder in which the grinding belt is looped around the pressure roll is involved, since, there, the obtainable diameter reduction manifests itself advantageously. For, the diameter of the pressure roll determines the distance over which the grinding belt is in engagement with the surface of the sheet. The larger the diameter, the flatter is the arc over which the grinding belt travels, and the greater is the extent of the contact area for a given thickness reduction per pass.

A longer engagement distance means more heating of the belt, because an individual grinding grain, which acts like a milling cutter, engages the sheet material over a longer distance and thereby assumes a higher temperature until it again becomes free and accessible to the action of the cooling air. In addition, the chip removal is made more difficult by a longer engagement distance and further heating results, because the chips are additionally heated by the friction on the engagement distance. The impaired chip removal can also lead to partial clogging of the grinding belt and thereby to a considerably worsened grinding action.

All these difficulties can be overcome if the pressure roll has a smaller diameter, which is possible with deflection controlled rolls consisting of a core and a hollow cylinder, since thereby the engagement distance at the surface of the sheet is decreased.

Deflection controlled rolls for instance, such as those described in German Pat. No. 1 026 609, German Offenlegungsschriften Nos. 14 61 062, 22 30 139, and 30 03 395 and U.S. Pat. No. 3,587,152 can be considered for use with the present invention.

DETAILED DESCRIPTION

Figure 1:
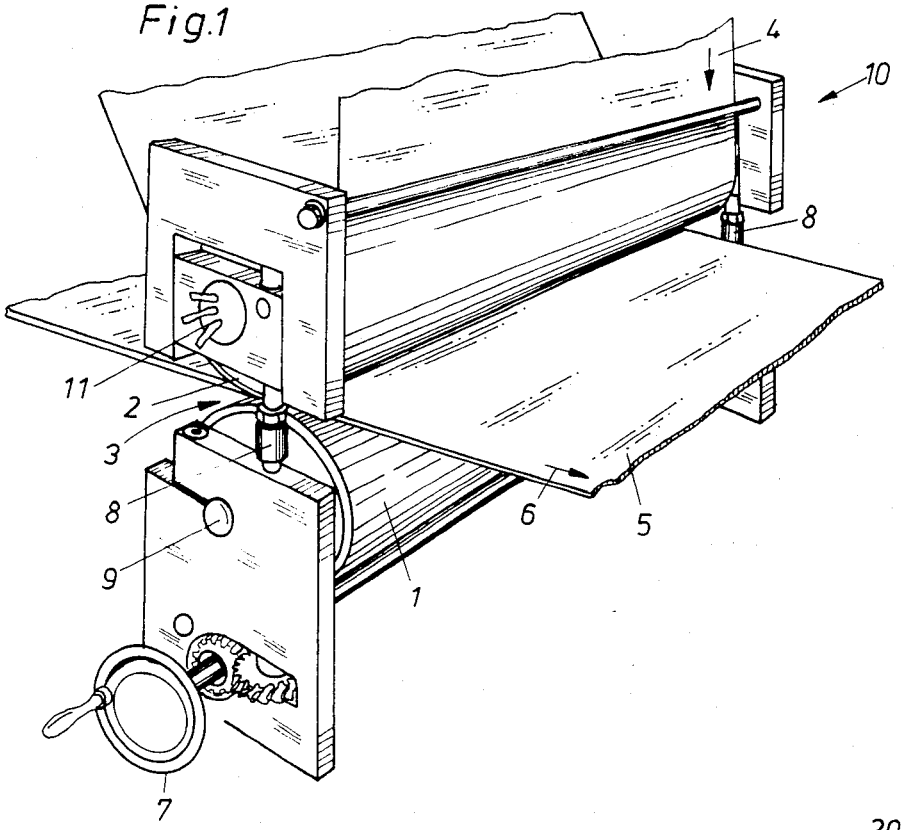
FIGS. 1 and 2 are perspective views of two kinds of belt grinders, in which the present invention is realized.

The belt grinder 10 according to FIG. 1 comprises a counterpressure roll 1 and a pressure roll 2 arranged parallel on top thereof, which together define a grinding gap 3. The grinding belt 4 is looped around the pressure roll 2, through the grinding gap 3, by means of a feed device, not shown, in a travel direction 6. In the process, the board 5 is ground on the top side by the grinding belt 4. The desired gauge can be set via a hand wheel 7 which acts on spindles 8, by means of which the bearings 9 and 11 of the rolls 1 and 2 can be positioned with respect to each other.

Figure 2:
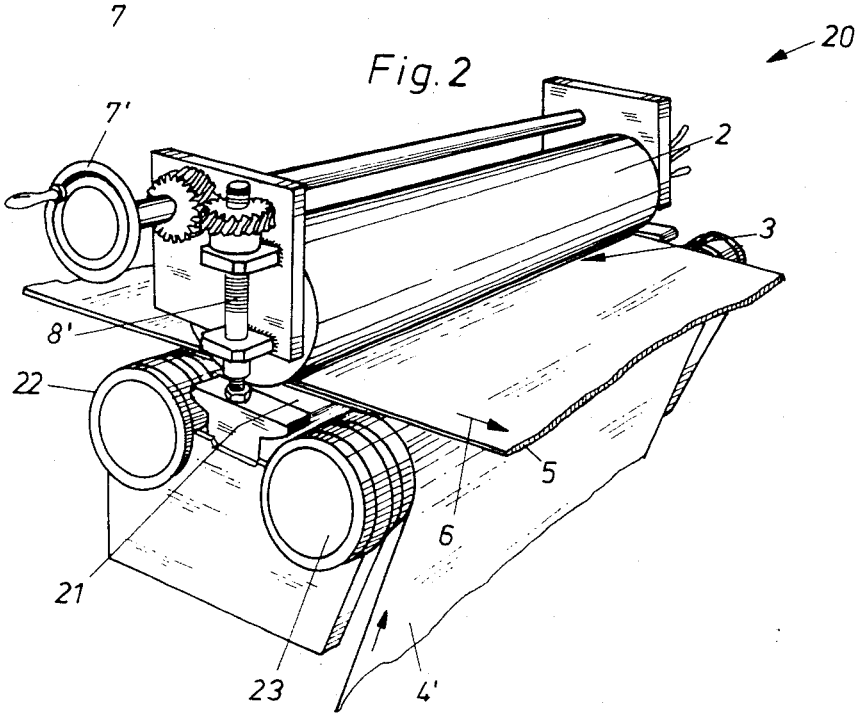

In the belt grinder 20 of FIG. 2, the sheet 5 is pushed forward along a fixed grinding beam 21 instead of a counterpressure roll 1. The grinding belt 4', which is deflected downward via deflection rolls 22 and 23, which rolls are adjacent to the grinding beam 21, parallel thereto and have approximately the same height, is guided over the grinding beam 21. Above the grinding beam 21, the pressure roll 2, which can be set to a given gauge via a hand wheel 7' and a spindle arrangement 8', is provided.

While in the belt grinder 10, the board is ground on the top side, the grinding is accomplished on the underside in the grinder 20.

In both embodiments, the pressure rolls 2 are designed as deflection controlled rolls with a fixed crosshead and a hollow cylinder revolving about it.

Figure 3:
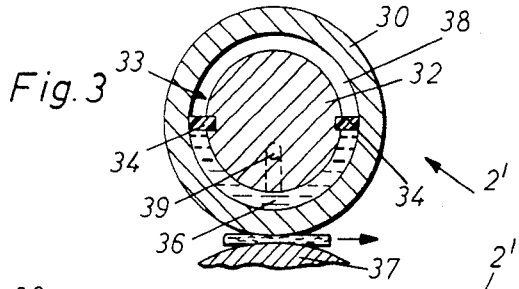
FIG. 3 is a cross section through a floating roll used as a pressure roll in the present invention.
Figure 4:
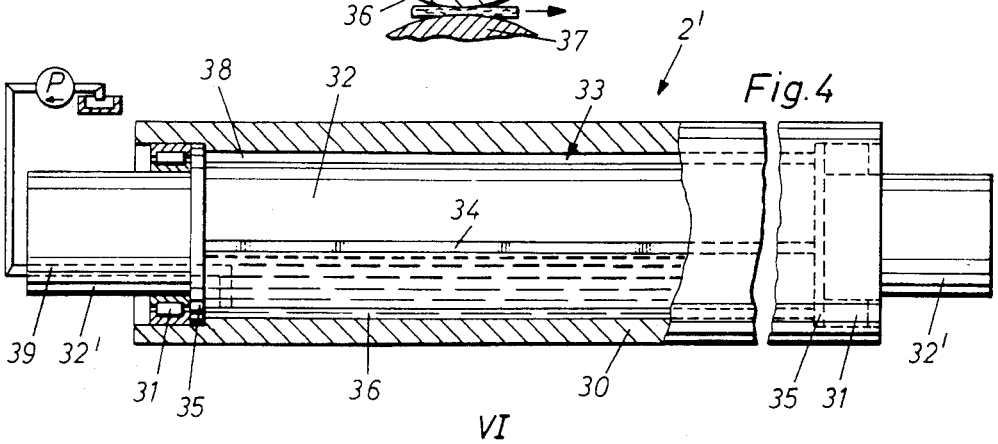
FIG. 4 is a partial longitudinal section through the roll according to FIG. 3.

FIGS. 3 and 4 indicate a first embodiment for such a deflection controlled roll, in which the roll is designed as a so-called floating roll 2'.

The roll 2' comprises a revolving hollow cylinder 30 which is supported in bearings 31 at its ends on a fixed crosshead 32. The crosshead 32 is spaced from the inside circumference of the hollow cylinder 30 on all sides, so that a space 33 is formed in which the crosshead can flex by a certain amount without touching the inside circumference of the hollow cylinder 30 and influencing the bending of the hollow cylinder. The ends 32' of the crosshead 32 protrude from the hollow cylinder 30 and are used for supporting the cylinder 2' in the machine frame, not shown.

The space 33 is subdivided by longitudinal seals 34 which are attached at approximately half the height of the crosshead 32 or at its widest point, into a longitudinal chamber 36 on the working side next to the counter roll 37 in FIG. 3, and a longitudinal chamber 38 on the opposite side. At the ends, the longitudinal chamber 36 is sealed off by transverse end seals 35, so that the longitudinal chamber 36 is closed and can be filled with pressure fluid via a feed line 39.

The pressure fluid exerts a downwardly directed pressure, according to FIGS. 3 and 4, against the inside circumference of the hollow cylinder 30, while being braced against the circumference of the crosshead 32, which is bent upward under this pressure according to FIG. 4. Due to the space between the crosshead 32 and the inside circumference of the hollow cylinder 30, the hollow cylinder 30 remains uninfluenced by this flexure. Since the ends of the hollow cylinder 30 are supported on the crosshead 32 via the bearings 31, the hollow cylinder 30 can be bent downward according to FIG. 4 by the application of a corresponding pressure.

Through the use of such a roll 2', a uniform line pressure and a uniform grinding gap can therefore be achieved even if the counter roll 1 in the belt grinder 10, which corresponds to the roll 37 in FIG. 3, is bent away downward.

Figure 5:
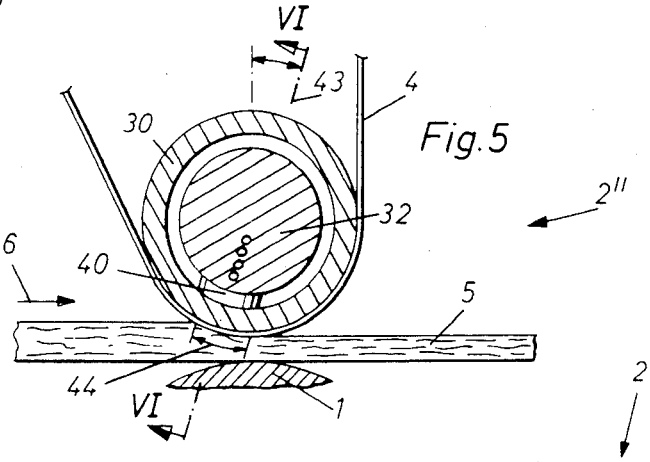
FIG. 5 is a partial cross section through the belt grinder according to FIG. 1 with a different pressure roll, the action plane of which is arranged at an angle.
Figure 6:
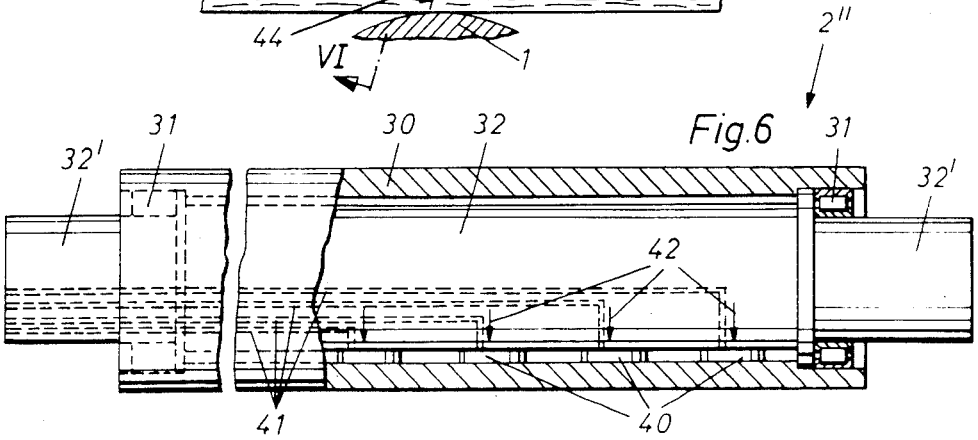
FIG. 6 shows a longitudinal section along the line VI—VI in FIG. 5.

In FIGS. 5 and 6, a roll 2' is shown which can be used as a pressure roll 2. Its basic design with the hollow cylinder 30 and fixed crosshead 32 corresponds to the roll 2'. To this extent, the same reference symbols are used also.

Contrary to the roll 2', however, no longitudinal chamber which is filled entirely with pressure fluid, is provided in the roll 2'. Instead, individual pressure shoes 40 are provided. These are successively lined up in the action plane and are supported in the crosshead 32 so as to be radially movable in the manner of piston-cylinder units to which a pressure fluid can be admitted which is fed through the crosshead 32 by lines 41. On the underside, which rests against the inside circumference of the hollow cylinder 30, the pressure shoes 40 form outwardly bounded flat chambers which are filled with pressure fluid, so that they are braced against the inside circumference of the hollow cylinder 30 on a hydrostatic cushion. Oil that passes under the edges of the pressure shoes serves for lubrication. The pressure shoes 40 exert individual forces which are indicated in FIG. 6 by arrows 42. Because the pressures in the lines 41 can be controlled separately, the forces exerted by the various pressure shoes 40 against the inside circumference of the hollow cylinder 30 can also be controlled individually.

While, with the roll 2', only a uniform pressure could be exerted against the inside circumference of the hollow cylinder 30, pressure can be exerted differently over the length of the hollow cylinder 30 with the roll 2', whereby a still wider adaptation to the required line pressure distribution is possible.

Through the position of the pressure shoes 40 and the symmetry plane in the case of the roll 2', an action plane is obtained which is indicated in FIG. 5 by the line 43. In this action plane 43 the rolls 2' and 2'' exert their forces and the hollow cylinders 30 are displaced relative to the core 32.

In the belt grinder 10 of FIG. 1, the pressure roll 2 is subjected not only to a force which is perpendicular to the plane of the sheet 5, and which attempts to flex the pressure roll 2 upward, but also to an additional force in the travel direction of the sheet 5, which attempts to flex the roll 2 parallel to the travel direction 6 parallel to the sheet 5. The action of both forces together lead to a resultant which is not always perpendicular to the sheet 5. To counteract the action of both forces, the action plane 43 of the roll 2'' is set at an angle opposite the travel direction 6 relative to the sheet 5 in the embodiment according to FIG. 5, so that it is parallel to the resultant total force exerted by the sheet 5 on the roll 2'', and is opposed to the resultant total force exerted by the roll 2''. In this manner, the influence of the feed of the sheet 5 can also be compensated.

By designing the pressure roll 2 as a flexure free roll 2' or 2'', the diameter of the pressure roll can be reduced for the same thickness tolerance of the ground board 5. Thereby, the engagement distance 44 (FIG. 5) which is obtained for a given removal height, is shortened. This has advantages with respect to the removal of the grinding dust, the heating of the grinding belt 4 and the required driving power.

The inclined position of the action plane can also be effected, of course, with a roll according to FIGS. 3 and 4. It is also understood that, optionally, the counter roll 1 in the belt grinder 10 can also be designed as a deflection controlled roll.

What is claimed is:

1. In a belt grinder for a chip board and the like including: an endless grinding belt which revolves in a longitudinal plane perpendicular to a feed direction for the board and extends over the width of the board; a pressure roll extending over the width of the board; a counter pressure element parallel to the pressure roll, the pressure roll and counter pressure element defining a grinding gap through which the grinding belt is conducted; and a feeding device for the board advancing the board in the feed direction, the improvement comprising: the pressure roll being a deflection controlled roll including: a fixed, rotation-proof cross head; a hollow cylinder supported on said cross head at each end by bearings, such that said cylinder is spaced from said cross head; means for applying a force between said cross head and said cylinder in an action plane oriented in a direction toward said grinding gap, thereby causing said hollow cylinder to be braced against said cross head from the inside, whereby a uniform line pressure or uniform height of grinding can be maintained to give high tolerances with a pressure roll of relatively small diameter.

2. The improvement according to claim 1, wherein said means applying a force are adapted to apply force in an action plane which is inclined in a direction opposite to the travel direction of the board through the grinding gap parallel to the direction of the resultant forces acting on the pressure roll.

3. The improvement according to claim 2, wherein said means applying pressure between said cross head and said hollow cylinder comprise hydraulic means whereby damping of vibrations which occur in the gap will take place.

4. The improvement according to claim 1, wherein said means applying pressure between said cross head and said hollow cylinder comprise hydraulic means whereby damping of vibrations which occur in the gap will take place.

* * * * *